United States Patent [19]

Carava

[11] 4,363,153

[45] Dec. 14, 1982

[54] INK TUB CLEANER

[76] Inventor: Sam S. Carava, 7 Pembroke La, Oak Brook, Ill. 60521

[21] Appl. No.: 232,670

[22] Filed: Feb. 9, 1981

[51] Int. Cl.[3] ..... B08B 9/18

[52] U.S. Cl. ..... 15/101; 15/56; 15/57; 134/159

[58] Field of Search ..... 15/57, 58, 90, 101, 15/104.05, 56; 134/166 R, 152, 159, 32

[56] References Cited

U.S. PATENT DOCUMENTS

| | | | |
|---|---|---|---|
| 1,770,201 | 7/1930 | Eaton | 15/58 |
| 2,195,202 | 3/1940 | Connal | 15/57 |
| 2,889,566 | 6/1959 | Parks | 15/58 |
| 3,144,032 | 8/1964 | Murayama | 134/152 X |

FOREIGN PATENT DOCUMENTS

| | | | |
|---|---|---|---|
| 140208 | 1/1935 | Austria | 15/57 |

*Primary Examiner*—Edward L. Roberts
*Attorney, Agent, or Firm*—Eugene F. Friedman

[57] ABSTRACT

An apparatus and method for cleaning residual material, such as printer's ink, from containers, generally cylindrical tubs. The apparatus effects the support and rotation of the tub in a tank containing a solvent. At least a portion of the tub sits within the liquid. The solvent acts on the dried ink to cause its disengagement from the container. A scouring material placed inside the tub helps to loosen the ink adhering to the tub's interior surfaces.

17 Claims, 3 Drawing Figures

INK TUB CLEANER

BACKGROUND

The manufacture of printer's ink generally involves its placement in a cylindrical metal tub. After each use, the tub must undergo a thorough cleaning to remove the ink that invariably adheres to its interior surface; any remaining material will contaminate future batches of ink placed inside the tub.

Cleaning residual material from a container that had found use in storing or transporting the material permits the reuse of that container. U.S. Pat. No. 40,797 to W. Robinson discloses an apparatus which tumbles a cask about an axis or end over end or in both of these modes. A scouring medium such as a chain, gravel and water, or other material, sealed inside the cask, effectuates its cleaning.

Other devices undertaking the cleaning of containers' insides in a similar manner as the above patent appear in U.S. Pat. Nos. 1,462,917 to J. H. Miller; 1,546,081 to W. H. Jones; 1,594,516 to H. J. Derosha; 1,755,763 to J. T. Barber; and 1,913,979 to C. C. Farrington. These pieces of equipment generally entail tightly sealing a cleaning medium inside the unclean container and clamping the container to the disclosed apparatus. Completing the cleaning procedure then requires the equally cumbersome reverse procedure of releasing the container from the apparatus, unsealing the container, and removing the cleaning medium.

None of these devices permit the cleaning of a container which does not have a completely enclosed interior volume. Nor do any clean the exterior of the containers which would likely have a coating of residual material. Further, none permit the replacement of spent or contaminated cleaning medium within the containers during the cleaning operation.

Cleaning residual material from containers represents a particular problem for tubs used in the manufacturing of printer's inks. The very nature of the inks themselves prohibits their facile removal from the tubs' surfaces. A commonly used procedure involves the use of a caustic heated to about 180° F. Manually scrubbing the tub with the heated caustic represents a difficult and dangerous procedure.

One automated machine employed for cleaning ink tubs makes use of the hot caustic. Accordingly, it requires a source of 220 volt electricity to provide the energy necessary to heat the solvent. It also has permanent plumbing connections to a source of water and to a drain. This expensive equipment occupies a large amount of space where located and consumes a similar quantity of energy to accomplish its task.

As a result, the search continues for equipment and a method that will efficiently and thoroughly clean residual material from the interior as well as exterior surfaces of a container. They should effectuate the cleaning without the necessity of sealing the cleaning medium inside the container or clamping the container to the apparatus.

SUMMARY

To effectively and inexpensively remove residual material from a container, a cleaning apparatus should include a mechanism for supporting and rotating the container. This mechanism then should sit on the bottom surface of a tank. In particular, the tank possesses an interior volume and shape which enables it to accomodate the supporting mechanism and allow the support and rotation of the container. The tank's structure should allow it a sufficient quantity of solvent to submerge at least a portion of the container when carried on the supporting structure. The location of residual material adhering to the container brings it into contact with the solvent when the container rotates.

Removing the residual material from the surfaces of a container involves submerging at least a portion of the container in a quantity of solvent. The location of the residual material, in relation to the submerged portion of the container, effects contact of the material with the solvent as the container revolves about some axis. Rotating the container about that axis enables the solvent to contact the material in the course of each revolution. As a result, adhered residue loosens and eventually undergoes removal from the container's surfaces. It then enters the solvent within the tank.

DETAILED DESCRIPTION

Figure 1:
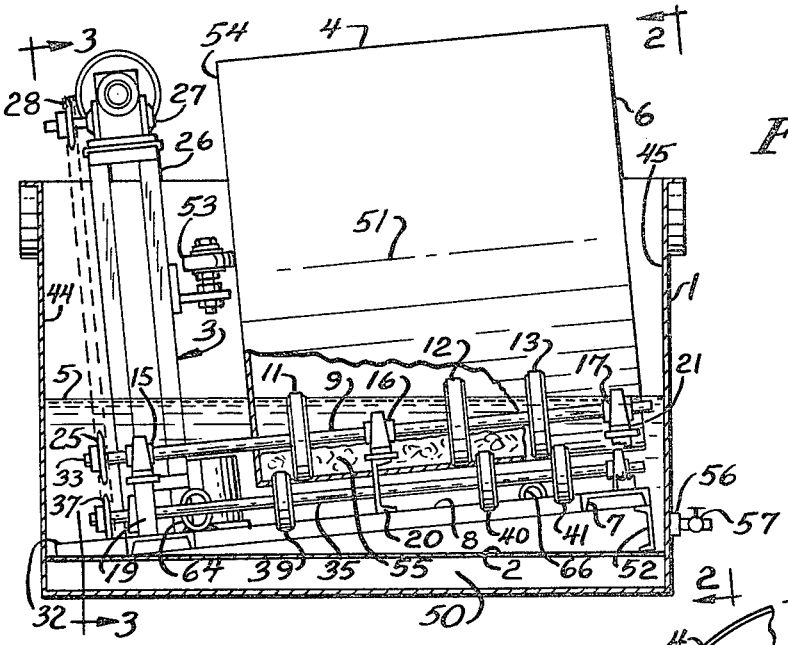
FIG. 1 provides a side elevational view, partially in section, of an apparatus which cleans a container by rotating it, while partially submerged, in a tank of solvent.

In the figures, the tank 1 includes the bottom surface 2 on which rests the supporting and rotating structure 3. The container 4 with the undesirable residual material sits upon the supporting mechanism 3.

The tank 1 contains a quantity of the solvent 5 to a depth sufficient to submerge a portion of the container. The location of at least part of the objectionable residue, relative to the submerged section of the container, causes it to contact the solvent as the container rotates. Preferably, the container 4 has the access hole or opening 6. When the tank 1 has a sufficient depth of solvent, the opening 6 enables the cleaner 5 to flow freely to and from the container's interior.

Usually the container 4 assumes a generally cylindrical shape, whichs denotes rotational symmetry about some axis. In this instance, the supporting and rotating mechanism includes the base 7 having the upper surface 8.

The support wheels 11, 12, and 13 rigidly attach to the shaft 9 in a wheel-and-axle relationship. The shaft 10 also has attached support wheels, only one of which, the wheel 14, appears in the figures. All of the support wheels 11 to 14 have substantially the same diameter.

The shafts 9 and 10 then rotatably couple to the base 7. Specifically, the journals 15, 16, 17, and 18 rotatably couple the shafts 9 and 10 to the support members 19, 20, 21, and 22, respectively, and to the member 23. The members 19 to 23 connect the journals 15 to 18 to the upper surface 8 of the base 7.

Antifriction bearings, such as the ball bearings, support the shafts 9 and 10 within the journals 15 to 18 without impeding relative rotational motion between them. Although permitting this rotational motion, the bearings prohibit relative transverse movement between these components. The relative locations of the base, shafts, and support wheels enable them to support the exterior curved surface of the container 4 upon the outer perimeters of the support wheels.

The driven wheels 24 and 25 rigidly attach to the shafts 10 and 9, respectively. The elongated frame 26 has a rigid affixation to the base 7 and extends upward from its upper surface 8. The rotational driver 27, shown as an electric motor, then attaches to the frame 26. The driving wheels 28, in turn, couples to the motor 27. Lastly, the closed-loop flexible tensile member 29 engages the outer perimeter of both the driving wheel 28 and the driven wheels 24 and 25. The operation of the motor 27 rotates the driving wheel 28 which causes the chain 29 to move. The moving chain 29 then rotates the driven wheels 24 and 25 which, in turn, effect rotation of the support wheels 11 to 14 through their respective shafts. As a result, the container 4 resting on the support wheels 11 to 14 also turns.

As indicated, a chain usually serves as the flexible tensile member 29. In this instance, the driven and driving wheels 24, 25, and 28 may include sprockets which engage the chain 29.

The wheel 30 may move towards and away from the frame 26 and thus the chain 29. As it moves toward the frame 26 and concomitantly, the chain 29, it eventually makes contact with the latter. Moving further in the same direction, it will place the chain 29 under tension. Locking the wheel 30 in this position removes slack from the chain 29 and allows it to operate more efficiently.

The base 7 includes a platform which may simply take the form of a flat plate having a substantially rectangular prism configuration. More likely, it will include a rigid framework formed of interconnected longitudinal and cross members. The other components of the supporting and rotating structure then attach to these members.

The upper surface 8 of the platform forms a plane. The center line 31 of the platform, of course, lies within this plane. The edge 32 of the platform's upper surface intersects the center line 31.

The longitudinal axes of the pair of shafts 9 and 10, as do the other pair discussed below, lie in a plane parallel to the plane of the upper surface 8. Furthermore, each of the shafts in a pair lie on opposite sides of and equidistant from the center line 31. One end of each shaft, including the ends 33 and 34 of the pair of shafts 9 and 10, has a location near or adjacent to the edge 32.

The driven wheels attach to the ends of their respective shafts near the edge 32. The driven wheels have substantially the same diameter in order that their respective shafts may turn at the same angular rate. Similarly, all of the support wheels on a pair of shafts display substantially the same diameter. As a result, all of the points of the support wheels in contact with the cylindrical container 4 travel with the same tangential velocity.

The elongated frame 26 attaches to the base 7 at a location near the intersection of the center line 31 and the edge 32. As a result, the perimeters of the driving and the driven wheels lie in substantially the same plane. This promotes the efficiency and simplicity of the transmission of force between the driving wheel 28 and the driven wheels 24 and 25 through the chain 29.

The additional pair of shafts 35 and 36 possess the associated driven wheels 37 and 38 and the supporting wheels 39, 40, 41, and 42. The shaft 35 and 36 in this pair lie closer together and lower in the tank 1 than the shafts 9 and 10. The second pair of shafts, as a result, will support a smaller container and yet submerge it to the same depth in the solvent 5 as do the shafts 9 and 10 for a larger container. In particular, the shafts 35 and 36, in FIG. 2, support the container 43 which has a diameter smaller than the container 4 in FIG. 1. Thus, mounting a plurality of shaft pairs at appropriate locations and heights on the base 7 permits the accomodation of differently sized containers.

Figure 2:
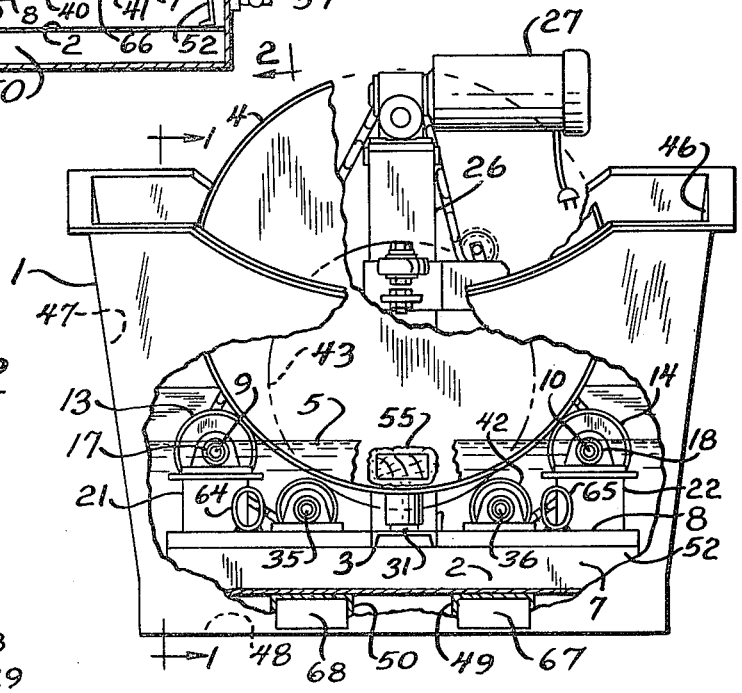
FIG. 2 gives a front elevational view, of the cleaning apparatus of FIG. 1, with a partial section illustrating one end of the supporting structure as well as a container's opening and interior. The line 1—1 in FIG. 2 indicates the section taken in FIG. 1.
Figure 3:
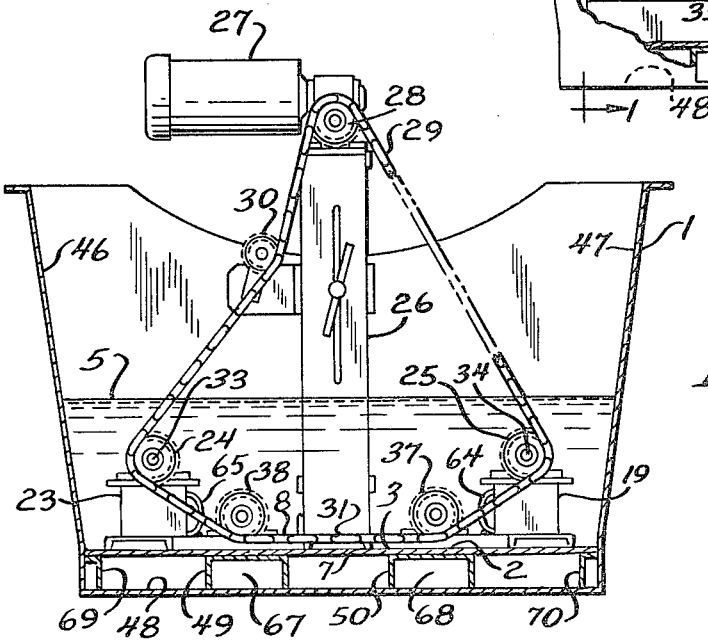
FIG. 3 has a cross-sectional view along the line 3—3 of the cleaning apparatus in FIG. 1, and shows the end of the supporting mechanism opposite the view of FIG. 2.

The interior surfaces of the tank 1 include the flat walls 44, 45, 46, and 47, and the horizontal bottom surface 2. The surface 2, as seen in FIG. 3, carries the supporting and rotating structure 3 when in the tank 1. The surface 2 sits on the top of and attaches to the channels 49 and 50 which run the length of the tank 1. The top surfaces of the channels lie in a common substantially horizontal plane to support the bottom surface 2. The layer of sheet metals 48 attaches to the bottom of the channels 49 and 50 and to the walls 44 to 47. The tank 1 has sufficient dimensions to hold the supporting and rotating mechanism with a container on the bottom surface 2. No moving component of the former nor any part of the latter should make contact with the tank's interior walls 44 to 47. A convenient geometric configuration for the tank 1 results in rectangular longitudinal cross sections, as shown in FIG. 1, and trapezoidal transverse cross sections as seen FIGS. 2 and 3.

Preferably, the platform of the supporting and rotating structure 3 tilts from the horizon when placed in the tank 1. In this manner, the edge 32 becomes the lowest part of the upper surface 8. The longitudinal axis 51 of the cylindrical container 4 forms an oblique angle relative to the horizontal. This angle may range from about 5° to 20°. The tilt is desired to hold the container 4 in place on the supporting and rotating structure 3. This ensures that a scouring device, discussed below, remains inside the container 4. To effect the tilt, the member 52 attaches transversely to the bottom of the platform 7 at the end opposite the edge 32. The member 52 raises the end to which it connects above the upper surface 2 and creates the desired tilt.

Because of the tilt, a revolving container on the supporting and rotating structure 3 tends to slide toward the frame 26. To prevent these components from abrading and possibly damaging each other, the support wheel 53 rotatably mounts to the frame 26. The wheel 53 rotates in a plane lying substantially parallel to the upper surface 8. The positioning of the support wheel 53 should permit it to contact the circular flat surface 54 forming the closed end of the container 4. Accordingly, the wheel 53 may have a vertical adjustment along the frame 26 to accomodate tubs of different diameters. The wheel 53 provides lateral support to a container when on the mechanism 3.

The scouring device 55, placed inside the rotating container 4, helps to clean its inside surfaces. With no attachment to the container, it remains free to slide along, and thus scrub, the inside of the container 4 as it rotates. The scouring device includes a solid object, such as a board or pipe, having about the same length as the container's depth. A scouring material should constitute part of or attach to its surface. The scouring device, of course, should display a greater density than the solvent to avoid its floating on the liquid's surface.

The scouring material could, for example, take the form of a scouring pad wrapped around a solid object.

An additional scouring device may have a fixed position against various surfaces of the rotating container. Particularly suitable sections of the container for receiving this treatment include its exterior surfaces and its inside of flat end 54. Maintaining slidable contact between the additional scouring device and these surfaces assists in their cleaning. The additional scouring device may attach to a handle or a pole which the operator grips. He then holds the scouring device against the desired surfaces to help remove the residual material.

Useful solvents include liquids capable of dissolving or suspending the residual material on the container. Liquids capable of merely softening and causing the residual material, perhaps with the assistance of one of the scouring devices, to become disengaged from the container also find use as the solvent.

The solvent may also act as a lubricant. It then serves to reduce the friction between the moving parts of the supporting and the rotating mechanism 3. As one example, when printer's ink constitutes the residual material, kerosene represents a very suitable solvent; it softens the ink which then sloughs off the container and settles into the solvent in the tank 1. It also lubricates the moving parts.

As with printer's ink, the removed material may accumulate as a sludge rather than dissolving in the solvent. Cleaning this type of material from several containers will result in an accumulation of sludge at the bottom of the tank 1. Eventually, removal of the sludge becomes necessary. Typically, this should occur before the sludge rises as high as the outlet port 56. This will keep it from reaching and interfering with any moving parts of the supporting and rotating mechanism 3. For the cleaning apparatus shown in the figures, an accumulation of about two inches of sludge should generally initiate its removal.

Briefly allowing the sludge to settle will provide relatively clear and clean solvent lying above the residue. Decanting this solvent through the outlet port 56 and the control valve 57 will allow for its subsequent reuse. Extracting the supporting and rotating mechanism 3 from the tank 1 permits the facile scrubbing and flushing of the sludge from the latter. The supporting mechanism 3 would then return to the tank 1 as would the decanted solvent. Adding fresh solvent compensates for the small amount lost with the sludge.

The eyelets, 64, 65, and 66 attach to the base 7 of the supporting and rotating mechanism 3. These can engage with hooks attached to a chain and pulley or other lifting device to enable the raising and lowering of the mechanism out of and into the tank 1.

The channels 67 and 38 attach to the bottom surface 2 of the tank 1. These may engage with the tines of a forklift truck to facilitate the transport of the cleaning apparatus to different locations.

The internal members 69 and 70 attach below and to the periphery of the bottom surface 2. They form a completely closed loop except for the openings 67 and 68 for a fork lift. These members provide support to the bottom 2 and to the tank's contents placed on it.

The present apparatus found use in removing residual printer's ink from the cylindrical tubs in which manufactured. The tubs' diameters ranged from 24 to 48 inches. The containers rotated in a solvent, kerosene, at about 7 to 10 revolutions per minute. A scouring device in the form of a wood board wrapped with a scouring material, placed inside the tub, scraped and wiped clean the interior curved surface. The operator pressed a scouring pad attached to the end of a pole against the tub's rotating surfaces not reached by the first device. The apparatus portends a savings in energy and thus finances compared to the equipment requiring a hot caustic. Furthermore, the method requires minimal labor, employs a safer cleaning material, and produces very little waste requiring disposal.

Accordingly, what is claimed is:

1. An apparatus for removing residual material from a cylindrical container which comprises:

A. moving means for supporting and rotating said container, said moving means comprising:
   1. a base having an upper surface;
   2. a pair of substantially parallel shafts rotatably coupled to said base above said upper surface;
   3. at least two support wheels of substantially the same diameter rigidly attached to each of said shafts in a wheel-and-axle relationship, said shafts, support wheels, and base being situated so as to enable support of said container at its exterior curved surface on the outer perimeter of said support wheels;
   4. at least one driven wheel rigidly attached to each of said shafts in a wheel-and-axle relationship;
   5. an elongated frame attached to said base and extending above said upper surface of said base;
   6. a rotational driving means coupled to said frame;
   7. a driving wheel rotatably coupled to said driving means; and
   8. a closed loop flexible tensile member engaged with the outer perimeters of said driving wheel and said driven wheels of each of said shafts so as to effect rotation of said driven wheels of each of said shafts in the same direction which in turn effects rotation of said support wheels via said respective shafts to effect rotation of said container when resting on said support wheels; and B. a tank means having a bottom surface on which said moving means is rested, said bottom surface being adapted to accomodate said moving means with said container supported on said moving means, said tank means being capable of containing solvent to a sufficient depth to submerge at least a portion of said container when supported on said moving means and to effect contact of said residual material with said solvent.

2. The apparatus of claim 1 wherein said base comprises a platform having (a) an upper surface defining a plane, (b) a center line lying in said plane, and (c) an edge on its upper surface which intersects said center line, the longitudinal axis of the shafts of each pair of shafts lying in a plane parallel to the plane of said upper surface, the shafts of said pair of shafts being on opposite sides of and equidistant from said center line, one end of each shaft being in proximity to said edge, said driven wheels of each shaft being of the same diameter and attached at said one end of said shafts, said support wheels on said pair of shafts all being substantially the same diameter, said elongated frame being attached to said base at a location adjacent to the intersection of said center line and said edge, the perimeters of said driven wheels of each shaft and said driving wheel lying substantially in the same plane.

3. The apparatus of claim 2 wherein the interior surfaces of said tank comprise walls and a bottom surface, said bottom surface being substantially horizontal when said tank rests on a horizontal surface, said tank being of sufficient dimensions that said moving means, with a container supported thereon, may be rested on said bottom surface without any moving part of said moving means or said container coming into contact with said walls.

4. The apparatus of claim 2 wherein said pair of shafts is a first pair and further including a second pair of shafts, the shafts of said first and second pairs being mounted at appropriate locations and heights on said base for said first and second pairs to accomodate containers of different sizes.

5. The apparatus of claim 2 wherein said tensile member comprises a chain, each of said shafts of said second pair includes a driven wheel connected to said shafts in a wheel-and-axle relation, and said driven wheels of said shafts and said driving wheel each possess sprockets for interengagement with said chain.

6. The apparatus of claim 2 wherein said rotational driving means comprises an electric motor.

7. The apparatus of claim 4 wherein said platform includes tilting means, coupled to said platform, for, when said platform rests in said tank, placing said edge of said platform at the lowermost part of said upper surface and the longitudinal axis of said container at an oblique angle to the horizontal, and further including an additional support wheel rotatably coupled to said frame, the rotation of said wheel occurring in a plane substantially parallel to the upper surface of said platform, said support wheel being positioned in a position to contact the circular flat surface forming a closed end of said cylindrical container to provide lateral support for said container, said additional support wheel being capable of vertical adjustment on said frame, thereby enabling the accomodation of containers of different diameters.

8. The apparatus of claim 1 wherein the rotatable mountings of said shafts comprise support members attached to the upper surface of said base; journals coupled to said shafts and to said support members; and antifriction bearing means coupled between said journals and support members in a manner which freely enables rotational but not transverse movement of said shafts.

9. The apparatus of claim 1 for a container possessing an opening to its interior wherein said depth of solvent submersion with said container supported on said support wheels, is sufficient to at least reach said opening of said container.

10. The apparatus of claim 9 further including a scouring means placed inside said container thereby enabling said scouring means to come into slidable contact with interior surfaces of said container as said container is rotated.

11. The apparatus of claim 10 wherein said scouring means comprises a solid object denser than said solvent with a scouring material forming at least part of its surface.

12. The apparatus of claim 11 wherein said scouring material comprises a solid object and separate scouring material surrounding and attached to said solid object.

13. The apparatus of claim 1 further including a solvent located within said tank and having lubricating properties.

14. The apparatus of claim 13 wherein, when said residual material includes printer's ink, said solvent comprises kerosene.

15. The apparatus of claim 1 including an outlet port connected to a valve on the outside of said tank to enable the decanting of relatively clean solvent from said tank.

16. The apparatus of claim 1 wherein said moving means includes a plurality of eyelets attached thereto to enable the lifting and lowering of said means out of and into said tank by means of external hooks engaged with said eyelets.

17. The apparatus of claim 1 wherein said tank has attached thereto external fittings engageable with the tines of a forklift to facilitate the transportation of the apparatus to desired locations.

* * * * *